United States Patent [19]

Rooney

[11] Patent Number: 4,597,682

[45] Date of Patent: Jul. 1, 1986

[54] IMPACT PRINT BAR ASSEMBLY

[75] Inventor: Harry B. Rooney, Laguna Hills, Calif.

[73] Assignee: Reflective Technology, Inc., Scotts Valley, Calif.

[21] Appl. No.: 670,987

[22] Filed: Nov. 13, 1984

[51] Int. Cl.[4] ..... B41J 11/08

[52] U.S. Cl. ..... 400/656; 400/554

[58] Field of Search ..... 400/656, 124, 144.2, 400/157.1–157.4, 544, 554, 657, 658

[56] References Cited

U.S. PATENT DOCUMENTS 1,942,747 1/1934 Degener ..... 400/656
4,318,452 3/1982 Reitner ..... 400/656 X

FOREIGN PATENT DOCUMENTS 73841 3/1983 European Pat. Off. ..... 400/656
352087 7/1931 United Kingdom ..... 400/656

*Primary Examiner*—Edgar S. Burr
*Assistant Examiner*—Moshe I. Cohen
*Attorney, Agent, or Firm*—Michael J. Hughes

[57] ABSTRACT

The present invention is an impact print bar assembly (10) adapted for installation in a typewriter, character printer or other device adapted for linear application of printed characters to sheet material. The assembly (10) includes an impact print bar (12) which is adapted to be held within a bar holder (14) in any of four different orientations, each of the orientations presenting a different print surface. The impact print bar (12) provides a solid, non-rotating, surface for the sheet material to reast against during printing. The impact print bar (12) includes a central support rod (28) having a resilient, usually plastic, body (36) formed thereabout. The degree of hardness of the body (36) may be varied, depending on the application desired. The support rod (38) has a square cross-section such that it will fit into the hollow frame (52) of the bar holder (15) in any of the four orientations. The print bar (12) is held within the bar holder (14) by a retention clasp (54), (56) such that it is a firm backup material for the paper during the print process. The primary commercial utilization of the invention is in impact printers such as daisy wheel, print thimble, print ball and dot matrix devices.

7 Claims, 4 Drawing Figures

IMPACT PRINT BAR ASSEMBLY

TECHNICAL FIELD

The present invention relates generally to typewriters and printers and more specifically to impact type printers.

BACKGROUND ART

Various devices have been developed over the years for imprinting characters and symbols upon paper or other sheet materials. Some of these devices, such as page typesetters, print more than one line at a time while some types of line printers print an entire line at a time. However, most common types of typewriters and printers print one character at a time and move along horizontal tracks across the page. Some of these printers do not require an impact surface since they print by means of thermal activation of chemicals within the paper. The direct impact type of printers, however, require some sort of impact surface against which the paper is held while the print character is impacted against a ribbon interposed between the character and the surface of the paper.

The traditional form of impact surface for character printers has been a rotating cylindrical platen. This platen, typically formed of rubber or other resilient material, serves the dual purposes of gripping the paper to feed it through the machine and of forming an impact surface for character striking. The great majority of all typewriters and printers produced since the late nineteenth century have used these rotating platens.

Modern dot matrix printers have occasionally used a stationary metal impact surface rather than a rotating platen. This is possible with dot matrix printers because the print impact mechanism includes a plurality of metal posts or pins which are driven against the ribbon, paper and the print surface. The metal pins are strong and are not subject to chipping or breakage by the hard surface. Furthermore, the quality of print expected from dot matrix printers is not as high as that expected from full character formation (letter quality) impact printers. Therefore, the rougher resulting appearance of the print, inevitably caused by the hard impact surface, is not detrimental to the performance and output of the printer.

For high quality printing of characters, however, it is desirable to have an impact surface which is at least somewhat resilient, such that the impact causes the paper to mold into the surface slightly and allows the character to be fully formed on the paper. This is especially important with lighter grades of paper. Resilient impact surfaces also significantly improve the lifetime of character printing elements, such as daisy wheels, which are frequently formed of plastic. For these reasons, and others, letter quality printers have continued to use the rotating cylindrical platen.

Platens have disadvantages in that they are relatively expensive to manufacture and difficult to replace in a given machine. They also maintain continuous contact with the paper over a wide surface and are liable to deliver soil or other contamination to the reverse surface of the printing medium during use. Since platens serve the dual purposes of gripping the sheet material for transport through the system and as an impact surface, the hardness of the platen material must be limited to that sufficient to provide proper gripping. This severely limits the lifetime of the platen since the surface will gradually become pocked and degraded by repetitive impacts.

For the purposes of modern data processing printers, the platen function of transporting the paper through the system is no longer necessary. Sophisticated roller wheels and other mechanisms can be utilized. This is particularly true since it is no longer necessary for the operator to continually observe what is being printed on the paper during the printing operation.

DISCLOSURE OF INVENTION

Accordingly, it is an object of the present invention to provide an improved print impact surface which remains stationary during utilization.

It is another object of the present invention to provide an impact surface which is less expensive and more easily manufactured than prior art devices.

It is a further object of the present invention to provide a print impact surface which may be reoriented to provide a total of four impact surfaces.

It is another object of the present invention to provide a disposable, easily modularly replaced print impact surface.

This invention relates to impact surfaces for character and symbol printing devices. It is specifically adapted for use with letter quality type printers wherein it is necessary that the impact surface be somewhat resilient in order to protect the character imprinting devices and further to guarantee that high quality print images are achieved. Specifically, the impact print bar device of the present invention is adapted for incorporation into the overall printer device of the inventor which is described in more detail in the co-pending applications entitled "Impact Print Mechanism Assembly", Ser. No. 670,986; "Ribbon Feed Mechanism Assembly", Ser. No. 670,986; and "Sheet Feeder Assembly", Ser. No. 671,002. The details of the various aspects of the overall impact printer device are shown and described in the above identified, simultaneously filed, applications. The interaction of these elements, as they directly relate to the print impact bar, will be described herein while the details of construction and operation are disclosed in the referenced applications.

Briefly, the preferred embodiment of the present invention is an impact print bar assembly adapted for installation in a typewriter, character printer, or other device adapted for linear application of printed characters to sheet material. The impact print bar assembly includes an impact print bar which is secured in position by a bar holder. The impact print bar itself includes a central support rod surrounded by a body which has flat sides and curved ends. The elongated body is symmetrical about both vertical and horizontal planes passing through the support rod. The body is constructed of a resilient material such as the plastic known as polyurethane. The curved end surfaces each include two elongated print surfaces formed to comprise approximately one-half of each end surface. The print bar is adapted to fit into the bar holder in any of four orientations so that any one of the four print surfaces may be presented to the impact area. The bar is held within the bar holder by a set of retention clasps which secure it in a firm position for proper printing. The impact print bar is adapted to be disposable and easily replaceable when the four available impact print surfaces are worn out.

An advantage of the present invention is that the impact print bar is inexpensive to manufacture and may be used as a disposable item.

Another advantage of the present invention is that the material of the impact print bar body may be harder and have a lower co-efficient of friction than a prior art platen since it, unlike platens, does not need to serve a purpose of gripping the sheet material for transport through the print area.

Still another advantage of the present invention is that the impact print bar may be easily re-oriented by the user without performing any substantial disassembly or difficult manipulations.

A further advantage of the present invention is that the impact print bar holder may be utilized with different types of impact print bars such as those with different body coefficients of hardness, and is thus adaptable for varying types of printing.

These and other objects and advantages of the present invention will become clear to those skilled in the art in view of the description of the best presently known mode of carrying out the invention and the industrial applicability of the preferred embodiment as described herein and as illustrated in several figures of the drawing.

BEST MODE OF CARRYING OUT INVENTION

The best presently known mode of practicing the present invention is an improved impact print bar assembly for incorporation into impact character printers and typewriters. The invention is particularly adapted for incorporation into the impact printer device of the inventor which is described in the simultaneously filed applications referenced above. The impact print bar assembly is further adapted for installation into any of a wide variety of other types of printers, so long as such printers include the means for delivering the sheet material through the print area.

Figure 1:
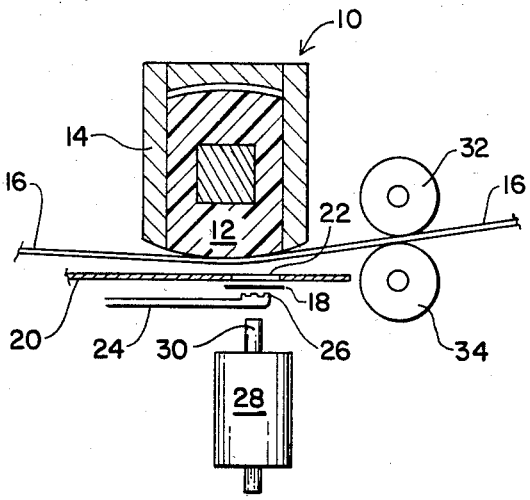
FIG. 1 is a cross sectional view of an impact print mechanism for a typical daisy wheel type impact printer, showing the impact print bar mechanism of the present invention.

The impact print bar assembly of the present invention is illustrated in FIG. 1 as part of an overall print mechanism assembly, which is shown in a cross sectional view taken through the center of the impact print area and along the transport axis of the sheet material. The impact print bar assembly is referred to by the general reference character 10.

In this illustration, it may be seen that the impact print bar assembly 10 includes a print bar 12 and print bar holder 14. These two elements are disposed above a sheet of paper 16 or other material upon which characters are to be printed. In the typical overall print assembly illustrated in FIG. 1, a print ribbon 18 is disposed in parallel relationship to the sheet of paper 16 with a paper shield 20 interposed therebetween. The paper shield 20 includes a print aperture 22 to permit a character lever 24, having a character 26 formed on one surface thereof, to impact the ribbon 18 through the aperture 22 and to force the ribbon 18 against the paper 16, which is disposed underneath the print bar 12. The impact is provided by an impact hammer device including a hammer solenoid 28 and a hammer shaft 30. The hammer shaft drives the character lever 24 against the ribbon 18 and thus causes the outline of the character 26 to be printed on the paper 16.

The paper 16 is caused to travel through the print area by a first paper roller 32 and a second paper roller 34 which are disposed in front of the impact print bar assembly 10. After a row of characters has been printed the first paper roller 32 and the second paper roller 34 will cause the sheet to advance a preselected distance such that the next row of characters may be printed.

The impact print mechanism illustrated in FIG. 1 is that shown and described in applicant's co-pending application entitled "Impact Print Mechanism Assembly".

Figure 2:
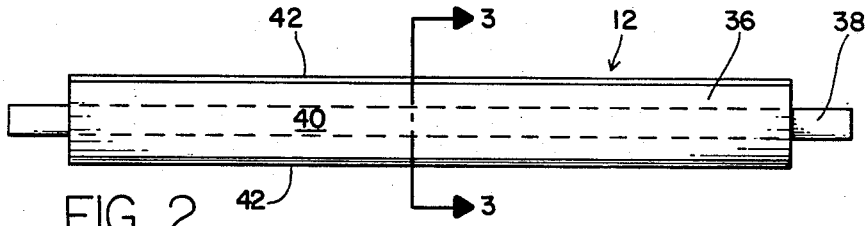
FIG. 2 is a front elevational view of the impact print bar element of the present invention.

Referring now to FIG. 2, the impact print bar 12 is shown separately in a front elevational view. In this illustration, it may be seen that the print bar 12 includes a resilient body element 36 and a rigid support rod 38. The body element 36 is a horizontally elongated solid having two flat sides 40 and two curved ends 42. The print bar 12 is symmetrical both about both the vertical and horizontal axes of the support rod 38 such that the opposing sides 40 are identical and further that the opposing ends 42 are identical to one another.

Figure 3:
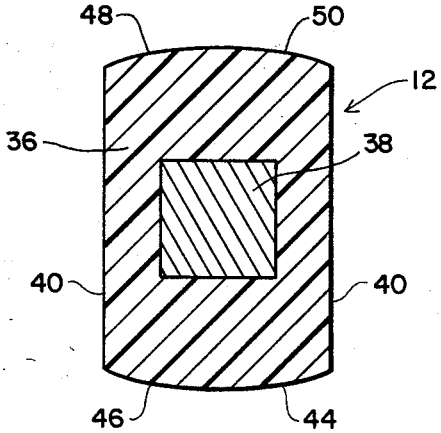
FIG. 3 is a cross sectional view, taken along line 3—3 of FIG. 2, showing the construction of the impact print bar.

The relationship with the various elements of the print bar 12 are further illustrated in FIG. 3, a cross-sectional view taken along line 3—3 of FIG. 2. In this illustration it may be seen that the sides 40 are parallel to one another and are flat. The ends 42 are slightly curved so as to provide the curved surface at the impact area. Although the ends 42 are identical to one another, it is convenient to refer to each end 42 as being divided into two separate impact print surfaces. Thus the preferred embodiment of the print bar 12 includes a first print surface 44, a second print surface 46, a third print surface 48 and a fourth print surface 50, all of which are formed on the ends 42. The four different print surfaces 44, 46, 48 and 50 are adapted such that when the print bar 12 is mounted within the print bar holder 14 (as shown in FIG. 1), one of said surfaces will be disposed directly above the aperture 22 in the paper shield 20. In this manner, the impact of the character lever 24 on the paper 16 will drive the paper directly against one of the four print surfaces 44, 46, 48 or 50 depending upon the specific orientation of the bar 12.

Figure 4:
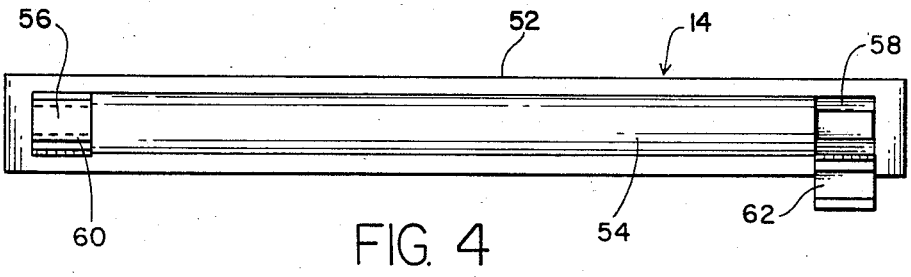
FIG. 4 is a top plan view of the print bar holder device of the present invention.

FIG. 4 illustrates the bar holder 14 in a top plan view. In this illustration it may be seen that the bar holder 14 includes a hollow frame member 52 which has an aperture 54 formed through the center thereof. The aperture 54 is identical in shape and size to the print bar 12 and is adapted to receive the print bar 12 therein such that two of the impact surfaces of the print bar 12 extend below the print bar holder 14. The hollow frame 52 is provided with a first slot 56 and a second slot 58, situated at the opposite ends of the frame 52, for receiving the ends of support rod 38 where the support rod 38 extends laterally beyond the ends of the body 36. The first slot 56 has an associated first retention clasp 60 and the second slot 58 has an associated second retention clasp 62 which may be closed to secure the print bar 12 in position within the print bar holder 14.

The particular materials and dimensions utilized for the print impact bar assembly of the present invention are dictated by the desired uses. The length of the body 36 of the print impact bar 12 is determined by the width of the printer in which the bar 12 is to be installed. For a typical 110 column (ten pitch) printer the body 12 will have a length of 29.5 cm (11.75 in) while the rod 38 will extend an additional 1.25 cm (0.5 in) beyond the ends of the body 36. The width of the print surfaces 44, 46, 48 and 50 is determined by the size of the characters 26 which are to be printed thereon. For a typical ten pitch character printer the print surface width will be 0.3 cm (0.125 in) and the overall width of the end 52 will be 1.25 cm (0.5 in.). The height of the body 36, and hence the length of the sides 40, is entirely a matter of choice in the design of the printer. In the preferred embodiment the sides 40 have a height of 1.9 cm (0.75 in).

For maximum durability, the inventor desires that as many of the components as possible be constructed of metal such that component failure is not a significant factor. Therefore, the bar holder 14, including the retention clasps 60 and 62, as well as the support rod 38, should be constructed of high durability metal, preferably stainless steel. The body 36 must have a certain degree of resilience and is preferably constructed of polyurethane, having a hardness factor of 75 on the Shore hardness scale (Durometers) for a typical use. The hardness factor may be adjusted for various uses, depending on the desired print quality and expected lifetime, and it is expected that impact print bars 12 will be manufactured having hardness factors in the range of 60 to 90 on the Shore hardness scale (Durometers).

Although the invention is shown and described herein as being specifically adapted for use with the Reflective Technology, Inc. printer mechanism illustrated in FIG. 1, it may also be utilized with any other sort of impact printer device, including dot matrix type printers. The only requirement in using this type of impact print bar is that an independent means exists for delivering the paper through the print area.

The first and second paper rollers 32 and 34 illustrated in FIG. 1, show one method of delivering the paper through the impact vicinity. However, any other means of delivering paper, many of which are well-known in the art, may be utilized with the present invention.

Those skilled in the art will readily observe that numerous modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The print impact bar assembly of the present invention is adapted for use with character printing devices such as typewriters and electronic printers. In particular, the assembly is adapted for installation in the impact printer device manufactured by Reflective Technology Inc. of Mission Viejo, Calif. However, it may be readily adapted for and installed in any of a wide variety of printers and typewriters. The impact print bar assembly is intended to be installed with one of the print surfaces 44, 46, 48 or 50 disposed directly opposite the print character impact device. The print bar 12 is secured in position within the print bar holder 14 such that the selected impact surface is maintained in a non-vibrational solid position. After a certain degree of use, when the user determines that the print surface has been worn out or otherwise wishes to change the print surface, the selected print surface may be changed. This is accomplished by opening the retention clasps 60 and 62 and removing the impact print bar 12 from bar holder 14. The print bar 12 may then be rotated about any of three mutually perpendicular axes and replaced within the bar holder 14 so as to present a different print surface to the character printing mechanism. An end to end rotation about a vertical axis will replace the first print surface 44 with the second print surface 46, an end to end rotation about a perpendicular horizontal axis of the print bar 12 will replace the first print surface 44 with the third print surface 48, and a rotation about the longitudinal central axis of the support rod 38 will replace the first print surface 44 with the fourth print surface 50.

When all four print surfaces have been utilized, or should the user desire to replace the print bar 12 with another of differing hardness, the entire print bar 12 may be removed and replaced as a modular item.

The impact print bar 12 is designed to be a low cost item such that it may be used in a disposable manner. This operates to minimize the cost of impact surfaces. In a typical usage, the print bar should be usable for the printing of approximately one hundred million (100,000,000) characters or a useful lifetime per print surface of approximately three months under normal conditions.

Due to the numerous advantages both in ease of use and operation and in economic considerations it is expected that the present invention will have widespread and long-lasting utility and applicability.

What is claimed is:

1. An impact print bar assembly, comprising:

an impact print bar in the form of a homogeneous body portion formed about a longitudinal central support rod such that the body portion is symmetrical about two mutually perpendicular planes, said support rod extending entirely through said body portion and projecting from both ends of said print bar, one of said planes including the central axis of said support rod, said body portion having parallel opposed side portions and opposing curved end portions, each of said end portions including two longitudinal print surfaces; and a U-shaped bar holder adapted to receive and hold the impact bar in any one of four different orientations, said bar holder being situated in the vicinity of an impact printer device such that characters printed by the printer device are printed by impact against a different one of said print surfaces for each different orientation of the impact bar within the bar holder.

2. The assembly of claim 1 wherein:

said central rod has a square lateral cross section.

3. The assembly of claim 2 wherein:

said rod extensions are adapted to fit into retention slots formed in the bar holder so as to be securable therein in either of two orientations by rotation of the bar plus two additional orientations when the bar is reversed end to end.

4. The assembly of claim 3 wherein:

the bar holder includes a pair of retention clasps situated about said retention slots to secure the bar in position.

5. The assembly of claim 1 wherein:

the bar holder includes a frame member having a rectangular longitudinal aperture formed therethrough, a pair of bar retention slots formed at the opposite ends thereof and a pair of bar retention clasps for holding portions of the impact bar securely in said respective bar retention slots such that said print surface is spatially secured during use.

6. The assembly of claim 1 wherein:

the bar holder includes fastening means which may be readily opened and closed to permit easy reorientation and replacement of the impact print bar.

7. The assembly of claim 1 wherein:

the impact print bar is disposable.

* * * * *